US006780834B2

(12) United States Patent
Schramm, Jr. et al.

(10) Patent No.: US 6,780,834 B2
(45) Date of Patent: Aug. 24, 2004

(54) FABRIC CONDITIONING COMPOSITIONS CONTAINING AN AMINE ACID SOFTENING COMPOUND

(75) Inventors: Charles Schramm, Jr., Hillsborough, NJ (US); Arthur Wagner, Roselle Park, NJ (US); Marianne Zappone, Mount Holly, NJ (US); Amjad Farooq, Hillsborough, NJ (US); Jeffrey T. Epp, Mount Arlington, NJ (US); Joseph Reul, Heusy (BE); Hoai-Chau Cao, Ans (BE); Alain Jacques, Blegny (BE); Alain Gourgue, Lincent (BE); Juliette Rousselet, Glons (BE)

(73) Assignee: Colgate-Palmolive Co., New York, NY (US)

( * ) Notice: Subject to any disclaimer, the term of this patent is extended or adjusted under 35 U.S.C. 154(b) by 64 days.

(21) Appl. No.: 10/209,048

(22) Filed: Jul. 31, 2002

(65) Prior Publication Data

US 2004/0023838 A1 Feb. 5, 2004

(51) Int. Cl.[7] ..... C11D 3/20; C11D 3/30
(52) U.S. Cl. ..... 510/515
(58) Field of Search ..... 510/515

(56) References Cited

U.S. PATENT DOCUMENTS 5,133,885 A 7/1992 Contor et al. ..... 252/8.6
5,154,838 A 10/1992 Yamamura et al. ..... 252/8.6
5,433,869 A 7/1995 Harmalker et al. ..... 252/8.8
5,476,598 A 12/1995 Schramm, Jr. et al. ..... 252/8.8
5,505,866 A * 4/1996 Bacon et al. ..... 510/517
6,692,536 B1 * 2/2004 Masschelein et al. ..... 8/115.6

FOREIGN PATENT DOCUMENTS

EP 0038862 1/1984
GB 2032479 5/1980

* cited by examiner

*Primary Examiner*—John R. Hardee
(74) *Attorney, Agent, or Firm*—Bernard Lieberman

(57) ABSTRACT

A wash cycle fabric softener composition which is dispersible in the wash water of a laundering operation including handwash. The fabric softener composition comprises, by weight:

(a) from about 48% to about 82% of at least one amine fabric softening active compound;

(b) from about 0.1% to about 18% of an alpha hydroxy aliphatic acid selected from the group consisting of citric acid, lactic acid, glycolic acid and mixtures thereof, wherein the amine fabric softening active compound at least partially reacts in situ with the alpha hydroxy acid to form an amine salt of the alpha hydroxy acid;

(c) from about 0.5% to about 6% of a cationic surfactant;

(d) from about 0% to about 9% of a cationic softener;

(e) from about 4% to about 14% of a perfume; and (f) less than about 6% of water.

15 Claims, No Drawings

FABRIC CONDITIONING COMPOSITIONS CONTAINING AN AMINE ACID SOFTENING COMPOUND

FIELD OF THE INVENTION

This invention relates to copending U.S. application (IR 6869) filed on even date herewith which describes unit dose fabric softening compositions comprising a water soluble container wherein there is disposed a fabric softener composition comprised of at least one amine fabric softening active compound.

BACKGROUND OF THE INVENTION

This invention relates to fabric softener compositions containing an amine fabric softening active compound. More particularly, this invention relates to fabric softening compositions which are particularly effective for softening fabrics in the wash cycle of a laundering operation concomitant to promoting the delivery of perfume to the fabric surface.

Compositions containing quaternary ammonium salts or imidazolinium compounds having at least one long chain hydrocarbyl group are commonly used to provide fabric softening benefits when used in a laundry rinse operation. Numerous patents have been issued for these types of compounds and compositions.

More recently, however, in view of concerns for the environmental safety (e.g., biodegradability) of the quaternary compound softeners, as well as limits in the amounts of these cationic compounds which can be stably incorporated into the more convenient to use liquid formulations, there have been many proposals for partial or total replacements for the conventional "quat" fabric softeners which are exemplified by dimethyl distearyl (or ditallow) ammonium chloride and various imidazolinium compounds.

For instance in GB 2,032,479A (corresponding to EP 038862) assigned to Albright & Wilson Ltd., water dispersible unquaternized hydroxyalkyl diamidoamine compounds are described in formula $$RNH((CH_2)_nNR)_mR$$

wherein an average of from 20% to 80% of the R groups are $C_{12}$ to $C_{22}$ acyl, at least 20% of the R groups are $—CH_2CH_2OH$ or $—CH_2CHOHCH_3$ or mixtures of these groups, and any other R group is hydrogen, n is 2 or 3 and m is an integer of from 2 to 5, are provided as mobile pastes in the presence of lower alkanol solvents. This is stated to be in contrast to partially neutralized unquaternized diamidoamine which, while providing highly effective fabric softening properties, are too viscous even when diluted in the lower alkanol solvents for convenient handling.

U.S. Pat. No. 5,154,838 (corresponding to EP 0459211A2) to Yamamura, et al. (assigned to Kao Corp.) discloses an aqueous liquid softener composition based on an amidoamine compound which is the condensation reaction product of a di- or tri-amine of formula (I)

$$R^1NH(C_mH_{2m}NH)_nH$$

with a fatty acid of formula (II)

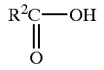

wherein $R^1$ represents a straight or branched chain, saturated or unsaturated hydrocarbon group having 8 to 24 carbon atoms, $R^2$ represents a straight or branched, saturated or unsaturated hydrocarbon group having 7 to 23 carbon atoms, m represents 2 or 3, and n is 1 or 2. These compounds, which are neither hydroxylated or ethoxylated, are noted to have high dispersibility in rinse water, especially when the amido amine compound is used in the form of its neutral salt.

In U.S. Pat. No. 5,133,885 to Contor, et al. assigned to Colgate-Palmolive Co., fabric softening compositions are described which are aqueous dispersions of a fatty acid ester quat of formula

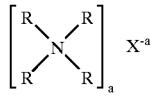

wherein one or two R groups represent an aliphatic ester residue of from 12 to 30 carbon atoms of formula $—(CH_2—)_nOCOR_4$ and the remaining R groups represent lower aliphatic, aralkyl or hydroxyalkyl groups, $X^-$ is an anion and "a" represents the ionic valence of the anion, and a fatty acid amido amine softener of formula

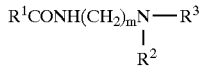

where $R^1$ is a $C_{12}$ to $C_{30}$ alkyl or alkenyl group, $R^2$ represents $R^1$, $R^1CONH(CH_2)_m$ or $CH_2CH_2OH$; $R^3$ represents hydrogen, methyl, or $(CH_2CH_2O)_pH$, m is a number of 1 to 5 and p is a number of 1 to 5, at a weight ratio of ester quat to amido amine of from 10:1 to 1:10.

U.S. Pat. Nos. 5,433,869 and 5,476,598, assigned to Colgate-Palmolive Company, disclose liquid rinse cycle softening compositions containing a fatty amido amine compound in the form of an acid complex as the principal softening component.

While these and many other proposals are known for improved fabric softening compositions, nevertheless, further improvements are desired to provide a softening composition capable of providing efficient softening in the wash cycle of a household washing machine concomitant with promoting perfume delivery to the fabric surface.

SUMMARY OF THE INVENTION

The present invention provides a wash cycle fabric softener composition which is dispersible in the wash water of a laundering operation, said fabric softener composition comprising, by weight:

(a) from about 48% to about 82% of at least one amine fabric softening active compound;

(b) from about 0.1% to about 18% of an alpha hydroxy aliphatic acid selected from the group consisting of citric acid, lactic acid, glycolic acid and mixtures thereof, wherein the amine fabric softening active compound at least partially reacts in situ with the alpha hydroxy acid to form an amine salt of the alpha hydroxy acid;

(c) from about 0.5% to about 6% of a cationic surfactant;

(d) from about 0% to about 9% of a cationic softener;

(e) from about 4% to about 14% of a perfume; and (f) less than about 6% of water.

Another embodiment of a wash cycle fabric softener composition in accordance with the invention comprises, by weight:

(a) from about 50% to about 70% of at least one amine fabric softening active compound;

(b) from about 13% to about 23% of an alpha hydroxy acid selected from the group consisting of citric acid and lactic acid and mixtures thereof, wherein the amine fabric softening active compound at least partially reacts in situ with the alpha hydroxy acid to form an amine salt of the alpha hydroxy acid;

(c) from about 0.5% to about 6% of a cationic surfactant;

(d) from about 3% to about 12% of a perfume; and (e) less than about 9% of water.

In accordance with another embodiment of a wash cycle fabric softener composition of the invention, there is provided a composition comprising, by weight:

(a) from about 28% to about 42% of at least one amine fabric softening active compound;

(b) from about 5% to about 15% of an alpha hydroxy acid selected from the group consisting of citric acid and lactic acid and mixtures thereof, wherein the amine fabric softening active compound at least partially reacts in situ with the alpha hydroxy acid to form an amine salt of the alpha hydroxy acid;

(c) from about 0.1% to about 4% of a cationic surfactant;

(d) from about 4% to about 12% of a perfume;

(e) from about 25% to about 50% of an alkali metal sulfate such as sodium sulfate; and (f) less than about 5% of water.

The term "fabric softener" is used herein for purposes of convenience to refer to materials which provide softening and/or conditioning benefits to fabrics in a home or automatic laundering machine or in a hand wash operation as well as effectively delivering fragrance to the fabric being cleaned.

The fabric softener compositions of the invention are preferably comprised of one or more fabric softening agents and a perfume.

In accordance with the process aspect of the invention there is provided a process for softening or conditioning laundry which comprises contacting the laundry in the wash water with an effective amount of the fabric softener compositions of the invention defined herein.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to softening performance so long as it meets the criteria of water immiscibility and having a pleasing odor. Naturally, of course, especially for softening compositions intended for use in the home, the perfume, as well as all other ingredients, should be cosmetically acceptable, i.e., non-toxic, hypoallergenic, etc.

DETAILED DESCRIPTION OF THE INVENTION

The fabric softening active compound is preferably an amido amine of formula (I)

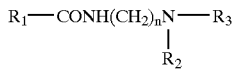

(I)

wherein $R_1$=$C_{12}$ to $C_{30}$ alkyl or alkenyl, $R_2$=$R_1CONH(CH_2)_m$, $R_3$=$(CH_2CH_2O)_pH$, $CH_3$ or H, n=1 to 5, m=1 to 5, and p=1 to 10.

In a more preferred softening compound of formula (I), $R_1$=$C_{16}$ to $C_{22}$ alkyl, n=1 to 3, m=1 to 3, and p=1.5 to 3.5.

In the above formulas, $R_1$ and $R_2$ are each, independently, long chain alkyl or alkenyl groups having from 12 to 30 carbon atoms, preferably from 16 to 22 carbon atoms, such as, for example, dodecyl, dodecenyl, octadecyl, octadecenyl. Typically, $R_1$ and $R_2$ will be derived from natural oils containing fatty acids or fatty acid mixtures, such as coconut oil, palm oil, tallow, rape oil and fish oil. chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture.

$R_3$ represents $(CH_2CH_2O)pH$, $CH_3$ or H, or mixtures thereof may also be present. When $R_3$ represents the preferred $(CH_2CH_2O)pH$ group, p is a positive number representing the average degree of ethoxylation, and is preferably from 1 to 10, especially 1.5 to 6, and most preferably from about 2 to 4, such as 2.5, n and m are each integers of from 1 to 5, preferably 2 to 4, especially 2. The compounds of formula (I) in which $R_3$ represents the preferred $(CH_2CH_2O)$ pH group are broadly referred to herein as ethoxylated amidoamines, and the term "hydroxyethyl" is also used to describe the $(CH_2CH_2O)pH$ group.

Especially preferred is the compound of formula (I) which is commercially available as Varisoft™ 510, from Sherex Chemical Company, which is bis(hydrogenated tallow-amidoethyl)-hydroxyethyl amine of formula:

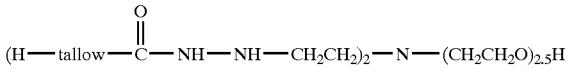

Another especially preferred fabric softening active compound is Adogen™ 343 available from Degussa, Goldschmidt Textile Care which is a bis(hydrogenated tallow) methyl amine.

An especially preferred composition consists of a mixture of Varisoft 510 and Adogen 343 in a weight ratio of 1.5:1 to 1:0.75.

In place of the Varisoft 510, or in combination therewith, the corresponding soft (non-hydrogenated) tallow derivative, available from Sherex as Varisoft 512, may be used. Varisoft 512 is ethoxylated with 3.5 moles, on average, rather than 2.5 moles EO as in Varisoft 510. The softening performance of the hard tallow derivative is somewhat better than that of the soft tallow. It has been found that when Varisoft 510 and Varisoft 512 are used in admixture, preferably at ratios of about 10:1 to about 1.5:1, preferably from 8:1 to 2:1, especially 6:1 to 3:1, both softening performance and stability are improved.

The cationic softener which may optionally be present in the solid fabric softener compositions defined herein is represented by the following formula:

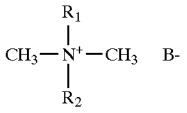

wherein $R_1$ and $R_2$ are each independently a $C_{12}$–$C_{22}$ alkyl or alkenyl group and B is an inorganic anion.

The inorganic anion B is selected from the group selected from the group consisting of chloride sulfate, hydrogen sulfate, nitrate, phosphate, hydrogen phosphate and dehydrogen phosphate and preferably is chloride. A preferred cationic softener is Arosurf™ TA-100 available from Degussa, Goldschmidt Textile Care wherein Arosurf™ TA-100 is a dimethyl ammonium chloride.

The cationic surfactant which can be used in the present compositions has the formula:

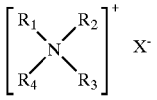

wherein $R_1$ is an alkyl or alkenyl radical containing from about 8 to about 22 carbon atoms, $R_2$ is an alkyl group of not more than 6 carbon atoms, $R_3$ and $R_4$, are each independently selected from the group consisting of alkyl of not more than 6 carbon atoms and —$(R5O)_nH$, wherein $R_5$ is an alkylene of 2 to 4 carbon atoms and n is a number of from 1 to 25, and $X^-$ is a water-solubl anion such as chloride or $CH_3SO_4^-$ methyl sulfate.

A preferred cationic surfactant is stearyl 15 EO ammonium methyl sulfate available as Adogen 66 from Degussa, Goldschmidt Textile Care.

In the following Examples the protocol for measuring the fragrance level on a dry fabric is referred to as the SPME Analytical Method. The protocol consists of the following:

Heated SPME Head Space Analysis of Dry Fabric

Solid phase microextraction (SPME; Almirall, J. R.; Furton, K. G. In Solid Phase Microextraction; A Practical Guide; Scheppers-Wercinski, S., Ed; Marcel Dekker; N.Y., 1999, pp. 203–216) is a solventless extraction technique through which analytes are extracted from a matrix (such as fabric) into a polymer or other phase, coated on a fused silica fiber. The SPME is coupled with gas chromatography (GC) for desorption and analyses of the analytes.

Materials

1. Gas Chromatograph with Ion Trap Mass Spec detection and SPME 0.75 mm ID inlet liner. (Varian GC3800/Saturn 2000 equipped with 8200 SPME Auto Sampler with Agitation and DBS Autotherm 12 sample Carousel.
2. GC column: CP-SIL-8CB-MS, 30 m×0.25 mm×0.25 m.
3. SPME Fiber: 100 micro meter polydimethlysiloxane (Supelco 57300-U (manual) or 57301 (automated))
4. 10 ml Head Space Vials with crimp top and 20 mm VITON septa (Supelco 27386 and 27245)

Method

1. Using clean dry scissors, cut (3) 1 gram swatches (2 g for malodor) from the terry cotton towel to be analyzed.
2. Using a glass rod insert each swatch into a 10 ml head space vial, being careful to insert far enough to not damage SPME fiber.
3. Cap vials and allow to equilibrate at room temperature for at least 24 hours.
4. Equilibrate vials at 50° C. for at least 45 minutes
5. Insert fiber and expose for 20 minutes at 50° C.
6. Inject into Gas chromatograph and desorb for 30 minutes at 250° C.

GC Conditions

| Injector Temperature: | | 250° C. |
|---|---|---|
| Column Flow: | | 1 mL/min |
| | Column Oven: | |
| Temp (° C.) | Rate (C/min) | Hold (min) |
| 50 | 0 | 5 |
| 200 | 5 | 5 |
| 220 | 5 | 1 |

Total run time: 45 minutes

EXAMPLE 1

A wash cycle fabric softener composition of the invention, in solid form (referred to herein as Composition A), was comprised of the following:

TABLE 1

| Active | Chemistry | Concentration |
|---|---|---|
| Varisoft 510 | Di H tallow amido amine | 60.7% |
| Adogen 343 | Di H tallow methly amine | 15.2% |
| Glycolic acid | | 8.6% |
| Adogen 66 | Stearyl 15 EO Quat Methyl Sulfate | 2.5% |
| Perfume | Fragrance | 9.3% |
| Water | | 3.7% |

Two washing experiments were conducted wherein Composition A was introduced into the wash cycle of an automatic washing machine during laundering, in the first experiment, in combination with a commercial liquid detergent composition and, in the second experiment in combination with a commercial powder detergent composition. The washes were carried out with a 6.5 lb. fabric load and dryer drying. The fragrance level on the dried fabrics were measured by SPME analysis.

For purposes of control a commercial rinse cycle softener (containing 0.7 to 1.1% perfume and 6 to 8% cationic softener active) was introduced in the rinse cycle during laundering and the fragrance level on the dried fabrics measured by SPME analysis. In a second control comparison, a commercial liquid detergent was used during laundering and the fragrance level on fabrics measured by SPME analysis.

In Table 2 below, the total amount of fragrance introduced into the rinse water by the rinse cycle softener is assigned the value of 1 and the fragrance level on the dried, fabrics is assigned the value of 100% to provide a reference for purposes of comparison. The relative amounts of fragrance introduced into the wash and measured on the dried fabrics when using the commercial liquid detergent composition and when using Compositions A are noted in Table 2 relative to the control.

TABLE 2

| Fragrance Containing Composition | Introduced Fragrance Ratio in wash | Relative Fragrance by SPME on Dried Fabric |
|---|---|---|
| Commercial rinse cycle softener (control) | 1 | 100% |
| Commercial liquid detergent (control) | 0.4 | 15% |
| Composition A (with liquid detergent) | 1.2 | 69% |
| Composition A (with powdered detergent) | 1.2 | 72% |

As noted in Table 2, Composition A delivered fragrance to the fabrics after dryer drying at about 70% of the fragrance level delivered by the rinse cycle softener control composition. By way of further comparison, the liquid detergent control composition delivered only 15% of the fragrance delivered by the rinse cycle softener.

EXAMPLE 2

A wash cycle fabric softener of the invention, in powder form (referred to herein as Composition B), was comprised of the following:

TABLE 3

| Coated Powdered System | | |
|---|---|---|
| Active | Chemistry | Powder |
| Adogen 343 | Di H tallow methly amine | 37.4% |
| Citric acid | | 9.8% |
| Adogen 66 | Alkyl EO Quat methyl sulfate | 1.9% |
| Perfume | Fragrance | 7.7% |
| Water | | 2.0% |
| Sodium sulfate | Bulking agent | 37.2% |
| Polyethylene glycol | Stability/improved flow | 4.0% |

Washing experiments were conducted wherein Composition B in combination with clay softener (4.2% fragrance) was introduced in the wash cycle of an automatic washing machine during laundering and compared to the use of a clay wash cycle fabric softener alone (containing 4.2% fragrance) and a commercial rinse cycle fabric softener containing 0.7% to 1.1% fragrance and 6% to 8% cationic softener active). Composition B in combination with softener was used at two levels. Use Level 1 was used to deliver a level of fragrance comparable to the commercial rinse cycle softener. Use Level 2 was used to simulate expected consumer use levels. The total amount of fragrance introduced into the rinse water by rinse cycle softener is assigned the value of 1 and the fragrance level measured on the dried fabrics is assigned the value of 100% to provide a reference for the purposes of comparison.

TABLE 4

| Results at Day 1 after drying fabrics | | | | |
|---|---|---|---|---|
| Fragrance Containing Composition | Fragrance Ratio in Wash Introduced by Clay | Fragrance Ratio in Wash Introduced by Composition B | Total Introduced Fragrance Ratio in Wash/Rinse | Relative Fragrance by SPME on Dried Fabric |
| Commercial rinse cycle softener (control) | 0 | 0 | 1 | 100% |
| Use Level 1 | | | | |
| Clay Wash Softener | 1 | 0 | 1 | 70% |
| Clay + Composition B | 0.7 | 0.3 | 1 | 92% |
| Use Level 2 | | | | |
| Clay | 2.3 | 0 | 2.3 | 132% |
| Clay + Composition B | 1.7 | 0.6 | 2.3 | 154% |
| Detergent only | 0 | 0 | 0.4 | 12% |

TABLE 5

| Results after aging fabric for 7 days | | | | |
|---|---|---|---|---|
| Fragrance Containing Composition | Fragrance Ratio in Wash Introduced by Clay | Fragrance Ratio in Wash Introduced by Composition B | Total Introduced Fragrance Ratio in Wash/Rinse | Relative Fragrance by SPME on Dried Fabric |
| Commercial rinse cycle softener (control) | 0 | 0 | 1 | 100% |
| Use Level 1 | | | | |
| Clay Wash Softener | 1 | 0 | 1 | 78% |
| Clay + Composition B | 0.7 | 0.3 | 1 | 98% |

TABLE 5-continued

| Fragrance Containing Composition | Results after aging fabric for 7 days: Fragrance Ratio in Wash Introduced by Clay | Fragrance Ratio in Wash Introduced by Composition B | Total Introduced Fragrance Ratio in Wash/Rinse | Relative Fragrance by SPME on Dried Fabric |
|---|---|---|---|---|
| Use Level 2 | | | | |
| Clay | 2.3 | 0 | 2.3 | 155% |
| Clay + Composition B | 1.7 | 0.6 | 2.3 | 182% |
| Detergent only | 0 | 0 | 0.4 | 23% |

As noted in Table 4, the wash system containing Composition B (at Use Level 1) delivered fragrance to the fabrics after dryer drying about 92% of the fragrance level delivered by the rinse cycle softener control composition. As noted in Table 5 this same system showed effective long lasting fragrance such that after 7 days the relative fragrance was about 98% of the fragrance level delivered by the rinse cycle softener control composition at 7 days. The data in Table 4 at both Use Level 1 and Use Level 2 demonstrated that the use of Composition B enhanced fragrance on dry fabrics beyond that observed for the clay wash softener alone. The data in Table 5 at both use Level 1 and Use Level 2 demonstrated that use of Composition B increased the longer lasting fragrance benefit beyond that observed for the clay wash softener alone.

What is claimed is:

1. A wash cycle fabric softener composition which is dispersible in the wash water of a laundering operation, said fabric softener composition comprising, by weight:

(a) from about 48% to about 82% of at least one amine fabric softening active compound;

(b) from about 0.1% to about 18% of an alpha hydroxy aliphatic acid selected from the group consisting of citric acid, lactic acid, glycolic acid and mixtures thereof, wherein the amine fabric softening active compound at least partially reacts in situ with the alpha hydroxy acid to form an amine salt of the alpha hydroxy acid;

(c) from about 0.5% to about 6% of a cationic surfactant;

(d) from about 0% to about 9% of a cationic softener;

(e) from about 4% to about 14% of a perfume; and (f) less than about 6% of water.

2. A wash cycle fabric softener composition as in claim 1 wherein the amine fabric softening active compound of (a) is bis(hydrogenated tallow) methyl amine.

3. A wash cycle fabric softener composition as in claim 1 wherein said amine fabric softening active compound is an amidoamine of formula (I)

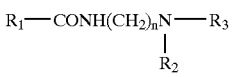

(I)

wherein $R_1$=$C_{12}$ to $C_{30}$ alkyl or alkenyl, $R_2$=$R_1CONH(CH_2)_m$, $R_3$=$(CH_2CH_2O)_pH$, $CH_3$ or H, n=1 to 5, m=1 to 5, and p=1 to 10.

4. A wash cycle fabric softener composition as in claim 3 wherein in the compound of formula (I):

$R_1$=$C_{16}$ to $C_{22}$ alkyl, n=1 to 3, m=1 to 3, and p=1.5 to 3.5.

5. A wash cycle fabric softener composition as in claim 1 wherein said alpha hydroxy aliphatic acid is citric acid.

6. A wash cycle fabric softener composition as in claim 1 wherein said cationic surfactant of (c) has the formula

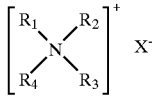

wherein $R_1$ is an alkyl or alkenyl radical containing from about 8 to about 22 carbon atoms, $R_2$ is an alkyl group of not more than 6 carbon atoms, $R_3$ and $R_4$, are each independently selected from the group consisting of alkyl of not more than 6 carbon atoms and —$(R_5O)_nH$, wherein $R_5$ is an alkylene of 2 to 4 carbon atoms and n is a number of from 1 to 25, and X is a water-soluble anion such as chloride or $CH_3SO_4$ methyl sulfate.

7. A wash cycle fabric softener composition as in claim 1 wherein said cationic softener of (d) is represented by the following formula:

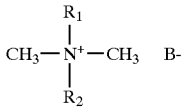

wherein $R_1$ and $R_2$ are each independently a $C_{12}$–$C_{22}$ alkyl or alkenyl group and B is an inorganic anion.

8. A method of softening fabrics comprising the step of contacting the fabric to be softened with an effective amount of the composition of claim 1 in the wash water during the wash cycle of a laundering operation.

9. A wash cycle fabric softener composition which is dispersible in the wash water of a laundering operation, said fabric softener composition comprising, by weight:

(a) from about 50% to about 70% of at least one amine fabric softening active compound;

(b) from about 13% to about 23% of an alpha hydroxy acid selected from the group consisting of citric acid and lactic acid and mixtures thereof, wherein the amine fabric softening active compound at least partially reacts in situ with the alpha hydroxy acid to form an amine salt of the alpha hydroxy acid;

(c) from about 0.5% to about 6% of a cationic surfactant;

(d) from about 3% to about 12% of a perfume; and (e) less than about 9% of water.

10. A wash cycle fabric softener as in claim 9 wherein the amine fabric softening active compound of (a) is bis (hydrogenated tallow) methyl amine.

11. A wash cycle fabric softener as in claim 9 wherein said amine fabric softening active compound is an amidoamine of formula (I)

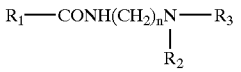

(I)

wherein $R_1$=$C_{12}$ to $C_{30}$ alkyl or alkenyl, $R_2$=$R_1CONH(CH_2)_m$, $R_3$=$(CH_2CH_2O)_pH$, $CH_3$ or H, n=1 to 5, m=1 to 5, and p=1 to 10.

12. A wash cycle fabric softener as in claim 11 wherein in the compound of formula (I):

$R_1$=$C_{16}$ to $C_{22}$ alkyl, n=1 to 3, m=1 to 3, and p=1.5 to 3.5.

13. A wash cycle fabric softener as in claim 9 wherein said alpha hydroxy aliphatic acid is citric acid.

14. A wash cycle fabric softener as in claim 9 said cationic surfactant of (c) has the formula

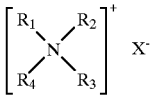

wherein $R_1$ is an alkyl or alkenyl radical containing from about 8 to about 22 carbon atoms, $R_2$ is an alkyl group of not more than 6 carbon atoms, $R_3$ and $R_4$, are each independently selected from the group consisting of alkyl of not more than 6 carbon atoms and —$(R_5O)_nH$, wherein $R_5$ is an alkylene of 2 to 4 carbon atoms and n is a number of from 1 to 25, and X is a water-soluble anion such as chloride or $CH_3SO_4$ methyl sulfate.

15. A method of softening fabrics comprising the step of contacting the fabric to be softened with an effective amount of the composition of claim 9 in the wash water during the wash cycle of a laundering operation.

* * * * *